United States Patent [19]

Moody et al.

[11] Patent Number: 4,505,341

[45] Date of Patent: Mar. 19, 1985

[54] COMBINATION CLEAN-OUT AND DRILLING TOOL

[76] Inventors: Arlin R. Moody, Box 277, Loving, Tex. 76062; Bobby J. Moody, Box 477, Highway 114 West, Levelland, Tex. 79336

[21] Appl. No.: 562,723

[22] Filed: Dec. 16, 1983

Related U.S. Application Data

[63] Continuation-in-part of Ser. No. 358,652, Mar. 16, 1982, Pat. No. 4,421,182.

[51] Int. Cl.[3] ..... F21B 21/10

[52] U.S. Cl. ..... 175/65; 175/213; 175/308; 166/105.1; 166/321

[58] Field of Search ..... 175/65, 213, 308, 234; 166/105.1–105.4, 99, 107, 167, 311, 319, 321

[56] References Cited

U.S. PATENT DOCUMENTS

| | | | |
|---|---|---|---|
| 1,968,282 | 7/1934 | Cavins | 166/301 |
| 2,088,151 | 7/1937 | Cavins | 166/311 |
| 2,894,585 | 7/1959 | Erwin | 166/301 |
| 2,992,680 | 7/1961 | Yates | 166/107 |
| 3,255,820 | 6/1966 | Brandon | 166/249 |
| 3,406,757 | 10/1968 | Baumstimler | 166/99 |
| 3,446,283 | 5/1969 | Baumstimler | 166/311 |
| 3,651,867 | 3/1972 | Baumstimler | 166/99 |
| 4,043,150 | 8/1977 | Baumstimler | 166/311 X |
| 4,142,583 | 3/1979 | Brieger | 166/311 |
| 4,161,985 | 7/1979 | Fournier et al. | 166/321 |
| 4,190,113 | 2/1980 | Harrison | 166/311 |
| 4,421,182 | 12/1983 | Moody et al. | 175/65 |

*Primary Examiner*—Stephen J. Novosad
*Assistant Examiner*—Thuy M. Bui
*Attorney, Agent, or Firm*—Richards, Harris, Medlock & Andrews

[57] ABSTRACT

A tool (10) is disclosed which permits retrieval of an object (201) from within a bore hole having debris (210) surrounding the object. The tool (10) includes an upper assembly (12) and a lower assembly (14). The upper assembly (12) is secured to a drill or tubing string assembly (16) extending to the surface. The lower assembly (14) mounts the wash pipe (200). The lower assembly (14) includes a debris chamber (144) and a trap valve (148) for permitting one-way flow of debris and fluid therein. In hydrostatic operation, a lower valve assembly (126) is provided for opening to expose the upper portions of the tool (10) to the bore hole pressure and drive debris and fluid through the wash pipe and into the debris chamber. This activity permits the tool and wash pipe to move downwardly in the bore hole so that the wash pipe surrounds the object. Settling debris wedges the object within the wash pipe for removal. Hydraulic operation is permitted by use of a seal, guide and swab piston assembly (102) to drive debris and fluid into the debris chamber to wedge the object within the wash pipe. A tool (300) is also disclosed for use in surging perforations (310) and holes (344) in a bore hole by using a pack-off device (302).

55 Claims, 9 Drawing Figures

COMBINATION CLEAN-OUT AND DRILLING TOOL

CROSS REFERENCE TO RELATED APPLICATION

This application is a continuation-in-part of U.S. patent application Ser. No. 358,652, filed Mar. 16, 1982, now U.S. Pat. No. 4,421,182.

TECHNICAL FIELD

This invention relates to oil field production, and in particular to down hole operating devices.

BACKGROUND ART

An oil well is a hole bored through layers of rock formations to reach a level or bed of petroleum or gas. The desired petroleum or gas is often found at a depth as deep as 25,000 feet to 30,000 feet. After the initial bore hole is drilled with a drilling rig, a casing is run into the bore hole and cemented to the sides of the bore hole to keep the bore hole from collapsing.

If a casing is provided along the entire length of the borehole, the casing is perforated at the proper level to permit the top of the petroleum or gas to enter the casing for recovery. The casing may be run into the bore hole down to the hydrocarbon producing formation. This technique is referred to as open hole completion. The portion of the bore hole below the deposit is then unprotected from collapsing.

Almost all of the gas or oil wells drilled require some type of treatment to render the well productive. This often includes the pumping of acid; or acid and different sizes and grades of salt; or sand pumped under high pressure to fracture the formation in the oil or gas bearing layer. When the treatment is completed, some debris, formed by thge acid, sand, salt or other material, is left in the bore hole. This commonly leads to closing the hydrocarbon or gas producing formations to stop recovery.

Several techniques have been developed to remove debris from within a bore hole. A reverse unit may be employed which includes a rotary device above the oil or gas bore hole to turn a drill pipe or tubing. The drill pipe or tubing has a drill bit on the bottom end thereof and is run down into the bore hole to drill through the debris for cleaning or cleaning by drilling the well deeper. The reverse unit includes a pump on the surface at the bore hole for pumping fluid down hole to recover the debris and pump it to the surface. However, this technique is not always possible. Sometimes, cleaning or drilling circulation is impossible. In other instances, fluid may not be placed in gas wells as it will push the gas back into the formation and prevent little, if any, recovery of the gas.

To overcome this problem, several wire line clean-out tools have been developed. The tools are placed down hole on a wire line or cable suspended from the surface. The wire line tools basically operate on two principals, either hydraulic or hydrostatic. A hydraulic device is disclosed in U.S. Pat. No. 4,190,113 to Harrison issued Feb. 26, 1980. This type of device operates by alternatively evacuating and pressurizing a debris chamber with a pumping unit activated by the wire line. A one-way valve entering the debris chamber from the bore hole permits debris to flow into the debris container when the container chamber is evacuated. The debris is blocked from flowing out of the bore hole by the valve when the chamber is pressurized. The pumping assembly is operated until the debris container chamber is full of debris. The tool is then removed and cleaned for reuse.

Fluid pumped by the pumping assembly is discharged horizontally from ports in the device into the narrow annular space between the device and bore hole. This inhibits fluid motion downward in this annular space past these ports. In another device disclosed in this patent, a tubing string extends to the surface above the debris chamber. A kelly permits rotation of a notched collar below the chamber through the tubing string to break debris crust in the well bore. The presence of an empty tubing string in the well bore raises the potential for tubing collapse if the hydrostatic pressure in the well bore acting on the walls of the tubing string becomes too large.

The previously known hydraulic types of tools have several shortcomings. The vacuum within the chamber is limited and heavy or large debris will not be recovered. The pumping action also permits the tool to become submerged within the debris and possibly be incapable of recovery by the wire line. An extremely costly and time consuming fishing job is then required to get the tool from the well.

U.S. Pat. Nos. 3,406,757, 3,446,283 and 3,651,867, issued on Oct. 11, 1968, May 27, 1969 and Mar. 28, 1972, respectively describe hydrostatic tools. Each of these patents is issued to Baumstimler. In a hydrostatic tool, the tool is run down the bore hole with a sealed debris chamber at atmospheric pressure. The tool is set down on top of the debris in the well. A valve is then opened permitting the fluid in the bore hole to enter the debris chamber. With sufficient fluid in the bore hole, the hydrostatic head is much greater than the atmospheric pressure within the debris chamber and the inrush of fluid entrains debris into the debris chamber. The tool must then be lifted from the bore hole to remove the debris in the debris chamber.

The hydrostatic tool also suffers shortcomings. The hydrostatic head in the bore hole where the debris is located must be relatively high to permit satisfactory operation of the hydrostatic tool. It is quite expensive to add sufficient fluid to the bore hole to achieve this hydrostatic head if it is not provided naturally. When the well is returned to production, the fluid has to be recovered and disposed of at additional cost. While the hydrostatic tool is effective on large and heavy debris, there is little control of how much the debris containing chamber will contain. Prior known tools provide little control of fluid motion once the debris chamber is exposed to the bore hole pressures and the hydrostatic tool can easily become submerged within the debris and require a fishing operation for removal.

A need exists for a tool which may be employed as either a hydraulic or hydrostatic tool without major modifications to achieve the advantages of either tool operation in a particular application. A need also exists to develop a tool with a capacity to provide sufficient forces to lift the tool in either mode of operation from within the debris in the bore hole. U.S. Pat. No. 2,992,682 issued July 18, 1961 to Yates discloses a combination tool operable in both the hydrostatic and hydraulic mode. However, this tool is not readily transferrable from one mode of operation to the other and still retains the shortcoming of other known tools in failing to provide an effective technique for removing the tool from the bore hole when buried in debris.

In addition to the debris found in the bore hole, larger objects can also become an impediment to drilling and production. The object can be, for example, broken tubing, a logging tool, a sinker bar, drill collars or many other possibilities. These objects are frequently surrounded by debris, making it difficult to grasp the object with conventional tools and possibly embedding the object within the debris. The object may even be totally submerged in debris which further complicates the removal thereof.

One common source of such objects that need retrieval are either a production string or a work string which has broken along its length or become so wedged by debris in the bore hole that it cannot be removed by merely pulling the string to the surface.

A need therefore exists for a technique to effectively remove such objects from within the bore hole. If they remain in the bore hole, these objects can reduce or completely stop production of the well. Such a technique must both provide for release of the object from the debris surrounding it and provide for lifting of the object to the surface for disposal.

As noted previously, there are many different methods of treating an oil well in order to enhance recovery of oil and gas from a hydrocarbon producing formation. One of the most common methods is the pumping of different grades and stages of sand, salt or acid and the like under pressure into the bore hole so that the pressurized material passes through the perforations in the casing of the well bore and into the formation. This pressurized material fractures the formation to form a fracture zone or enlarges already existing fractures in the oil and/or gas producing formation. This fracturing treatment opens up the formation, creating cavities and void spaces in the formation near the perforations in the casing. The fractures enhance the flow of gas and oil from the fractures, through the perforations and into the well bore.

However, fine debris, emulsions or natural formations such as sugar sand can collect in the formation, perforations and the well bore. As long as there is continuous fluid flow within the well bore, these debris materials will commonly remain in suspension and cause no reduction in production. However, if fluid motion ceases, the debris material will settle out of the suspended state and can create a blockage in the formation, the perforations through the casing or even within the well bore itself. These blockages can lead to significant decreases in well production. It can readily be seen that a decrease in production leads to significant economic losses.

Even if blockage does not occur with the debris, the supended debris will accelerate pump failure. The debris will cause excessive wear of the pump. Removing the pump for replacement or repair is expensive in itself and, of course, the cost is increased by the loss in production during the repair or replacement down time required.

In the past, tools have been used to remove the debris from the formation and the well bore by setting a pack-off device above the perforations in the casing opening into the formation, or in an open hole if no casing is present. A swab device is then run down hole on a sand line from the surface. The swab device swabs the casing and "surges" or pulls the debris from the formation into the well bore.

The swab device and pack-off device must then be pulled from the well bore. The debris must then be removed from the well bore in yet another step by using a conventional tubing inserted in the well bore. This technique has not been found fully effective. One reason is the relatively limited force that can be exerted by the movement of the swab device to drive debris from the formation into the well bore. In addition, the technique clearly requires at least two insertions and removals of separate devices in the well bore, increasing the time necessary to complete the operation.

One of the major functions of the casing within the well bore is to protect the oil and/or gas producing zone from contamination with other underground fluid materials, including salt water, mud and fresh water. If a perforation or hole is formed or produced through the casing, for whatever reason, near a zone of contaminating fluid, the productivity of the well bore can be decreased or even destroyed. When such a perforation or hole is present, it must be patched or "squeezed", typically with cement.

State and federal regulations exist to insure that any repairs made to a hole in casing meets the necessary standards to insure the casing performs its function of protecting the productive zone. Obviously, the operating company producing the well has a significant economic interest in making a fast and effective repair.

In order to effectively patch an undesired hole in the casing, the cement must normally be pumped through the hole under pressure and into whatever cavity volume exists in the formation outside the casing into which the hole opens. The cavity and hole in the casing must be filled to the extent necessary so that entrance of contaminating fluids will not occur from the cavity into the bore hole and well bore fluids will not pass through the hole into the cavity. The concrete will have a particular curing agent added to the cement slurry mix. If the cement sets before a complete "squeeze" is accomplished, then the cavity and hole must be resqueezed, if possible, to form a complete repair.

In many instances, debris will be present in the cavity, hole or immediate area that will reduce the flow of the cement into the hole and cavity beyond. Since the setting time of the cement is predetermined by the setting agent used, a reduced rate of cement flow caused by debris may inhibit or prevent a successful squeeze job.

Therefore, it is desirable to remove any debris in the area of the repair prior to a squeeze sealing up the hole and cavity beyond the cement. In the past, no tool or technique has been developed that adequately performed this clean out function prior to a squeeze.

Therefore, a need exists for a tool and method of use which can be employed to effectively surge and clean debris from a well bore, any perforations through the casing of the well bore and the formation beyond the perforations. In addition, a need exists for a tool and method for cleaning a well bore, a hole through the casing of the well bore and the cavity in the formation beyond to permit more effective squeezing of the hole.

SUMMARY OF THE INVENTION

A tool for use in a bore hole for debris collection is provided. The tool includes a lower assembly having structure for mounting an accessory at the lower end thereof in the bore hole. A debris chamber is provided in the lower assembly for holding debris. A one-way valve positioned in communication with the bore hole and debris chamber permits fluid to flow only from the bore hole into the debris chamber. A barrel section in the lower assembly has a smooth cylindrical inner wall and is also in fluid communication with the debris chamber through a lower valve assembly. Closure structure encloses the upper end of the barrel section in the lower assembly which includes a noncircular aperture therethrough. An upper assembly is provided which has a hollow kelly with a noncircular cross section for sliding motion through the aperture in the closure structure for joint rotation of the upper and lower assemblies. A piston assembly is mounted on the kelly in sliding sealed contact with the inner wall of the barrel section and has at least one port for fluid communication between the debris chamber and hollow kelly, the closure structure and piston assembly being engageable to jerk the lower assembly free from debris. The lower part of the piston assembly further acts to open the lower valve assembly to permit flow between the debris chamber and hollow kelly. A fluid container in the upper assembly is provided in fluid communicationn with the hollow portion of the kelly. A drain valve is in fluid communication with the fluid container and the bore hole to relieve fluid pressure from the fluid container. An upper valve assembly permits flow only from the hollow kelly into the fluid container.

The tool is operable as a hydraulic tool by removing the lower valve assembly and oscillating the upper assembly to reciprocate the piston assembly and drive fluid and debris into the debris chamber during the upstroke. At least one discharge valve is provided in fluid communication with the debris chamber. The upper valve assembly and discharge valve open on the downstroke to release the pressure in the debris chamber. The tool is operable as a hydrostatic tool by removing the upper valve assembly with the lower valve assembly in place and moving the kelly downward to open the lower valve assembly, driving fluid and debris into the fluid chamber.

In accordance with another aspect of the present invention, the lower assembly secures a drill bit at its bottom end in the bore hole. Rotation of the upper and lower assemblies rotates the drill bit and permits drilling operation within the bore hole.

In accordance with yet another aspect of the present invention, jet ports are provided proximate the one-way valve between the bore hole and the debris chamber. The jet ports act to agitate and moisturize the debris within the tool for improved debris collection. Jet ports are also provided in the closure structure in communication with the interior of the barrel section for agitating debris upon upstroke of the piston assembly.

In accordance with another aspect of the present invention, a method for drilling a bore hole is provided. The method includes the step of rotating a tool with a drill string or tubing assembly. The tool has upper and lower assemblies with a drill bit being mounted on the lower assembly for contact with the formation to be drilled. The method further includes the step of reciprocating the upper assembly relative to the lower assembly. The upper assembly includes a piston assembly in slideable sealed contact with an inner sealing surface in a section of the lower assembly. The motion of the piston assembly drives fluid and debris from the bore hole into a debris container in the lower assembly to collect the cuttings formed during the drilling.

In accordance with yet another aspect of the present invention, a tool for use in a bore hole for retrieval of an object surrounded by debris is provided which can be operated in either a hydraulic or hydrostatic mode. The tool has structure for mounting a wash pipe at the lower end thereof. When the tool is operated in the hydraulic mode by reciprocation of the upper assembly to drive the debris into the debris chamber, the tool is permitted to lower itself within the bore hole so that the object enters the wash pipe and is removed from the bore hole with the tool. When the tool is operated in the hydrostatic mode, the tool is also permitted to lower itself within the bore hole so that the object enters the wash pipe and is removed from the bore hole with the tool. A method is also provided for using the tool in association with a wash pipe for operating the tool in either a hydraulic or hydrostatic mode to drive debris into the debris chamber of the tool while lowering the tool within the bore hole to permit the object to enter the wash pipe so that the object and tool can be removed from the bore hole.

BRIEF DESCRIPTION OF THE DRAWINGS

A more complete understanding of the invention may be had by reference to the following Detailed Description when taken in conjunction with the accompanying drawings, wherein.

DETAILED DESCRIPTION

Figure 1:
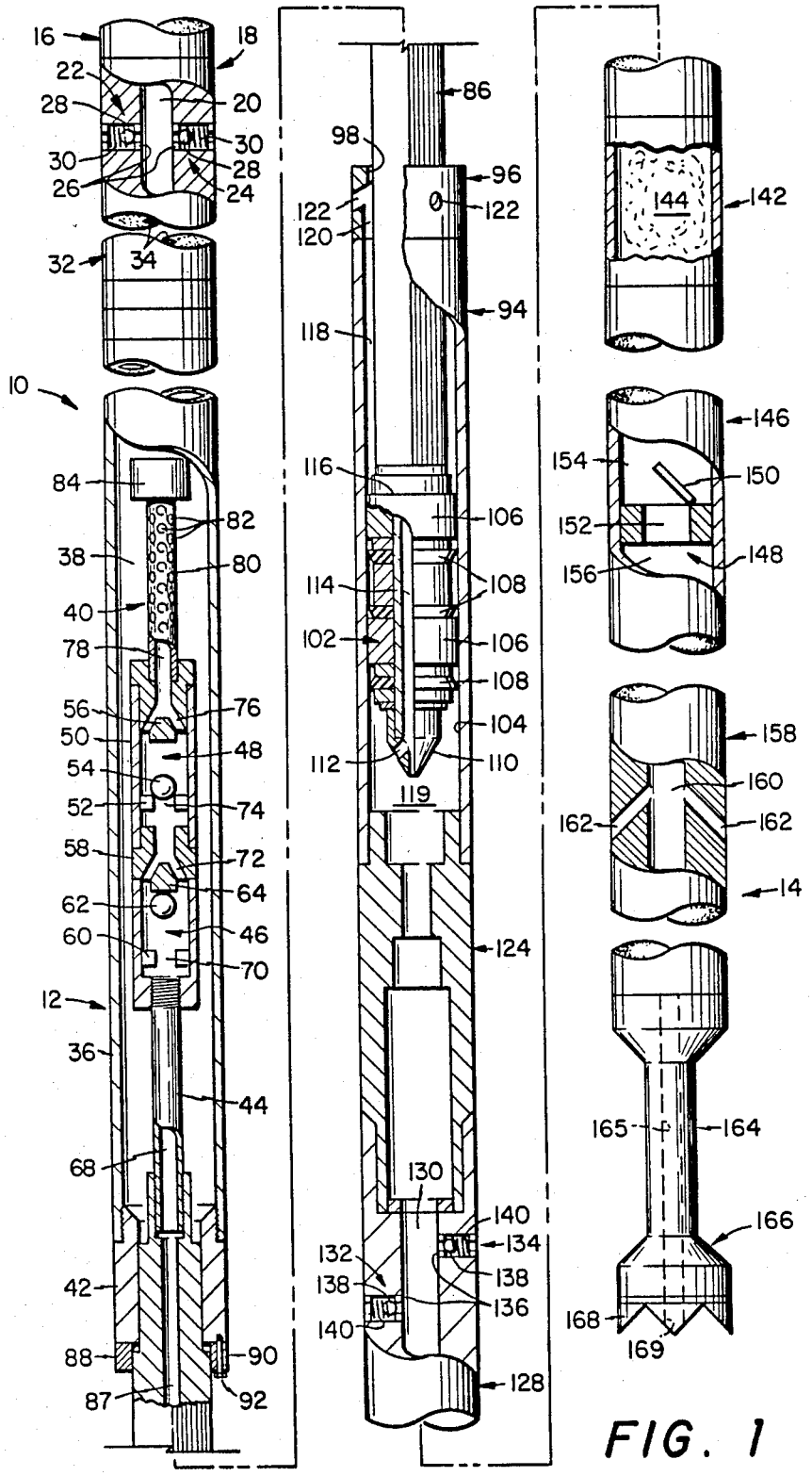
FIG. 1 is a vertical cross-sectional view of a tool forming one embodiment of the present invention adapted for use as a hydraulic clean-out or drilling tool.
Figure 2:
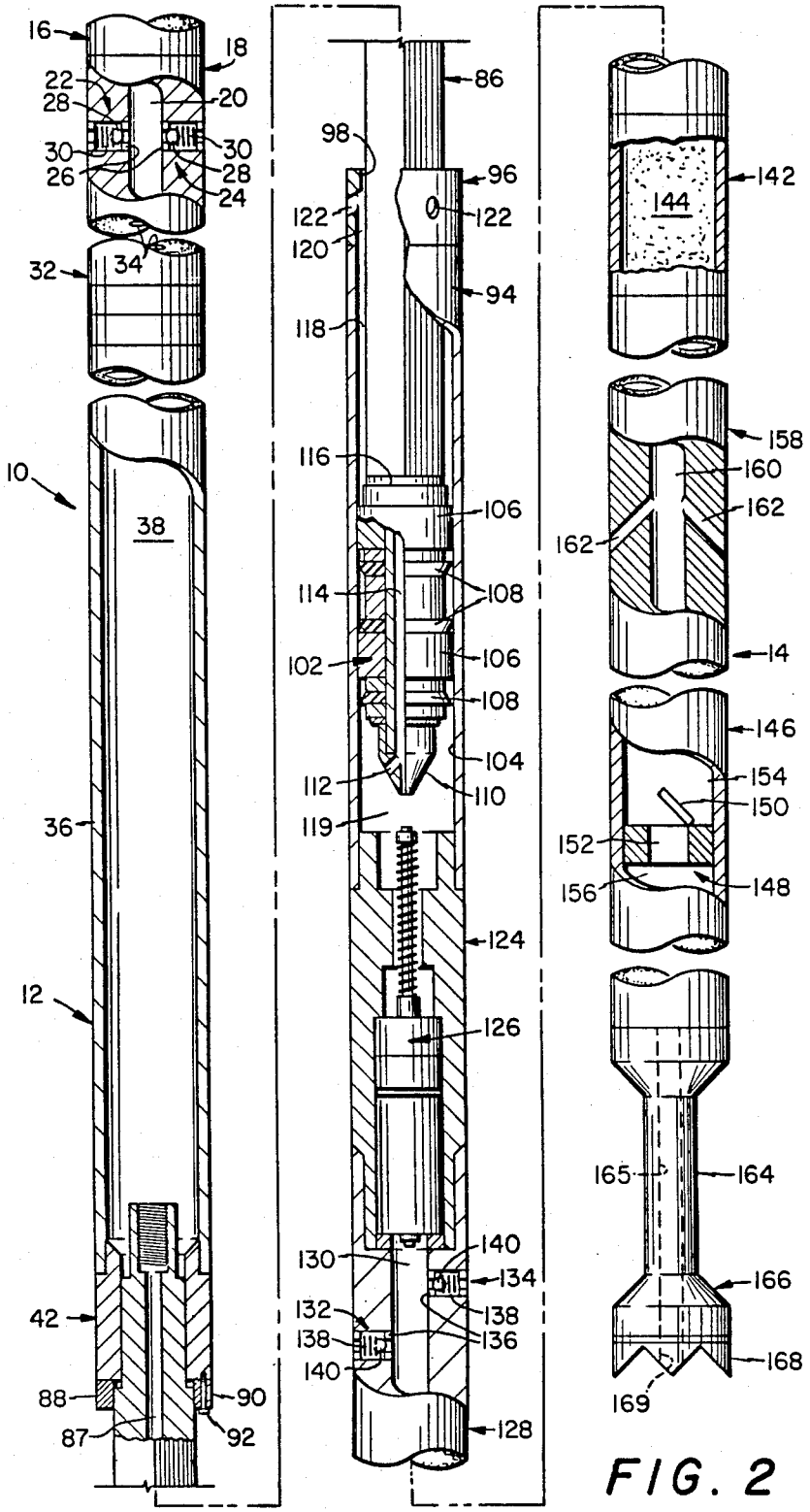
FIG. 2 is a vertical cross-sectional view of the tool adapted for use as a hydrostatic clean-out or drilling tool.

Referring now to the drawings, wherein like reference characters designate like or corresponding parts throughout several views, FIGS. 1 and 2 illustrate a tool 10 forming one embodiment of the present invention. The tool 10 functions as an improved clean-out tool and is operable in either a hydrostatic or hydraulic mode. In addition, the tool 10 may be operated as a drilling tool to drill a bore hole without need for circulation of drilling fluid from the surface to remove cuttings from the drill face as required in present drilling apparatus.

FIG. 1 illustrates the tool 10 employed as a hydraulic clean-out tool. Generally, the tool 10 comprises two major sections, an upper assembly 12 and a lower assembly 14. The upper assembly 12 is secured to the last section of a hollow core drill or tubing string assembly 16 which extends to the surface of the bore hole in which the tool is operated. The drill or tubing string assembly preferably comprises hollow tubing of the type employed in drilling operations.

The upper and lower assemblies are vertically aligned in the bore hole and reciprocal relative to each other as will be described in greater detail hereinafter. The upper assembly includes a drain valve subassembly 18 which is secured to the lower section of an assembly 16. The subassembly 18 includes a passageway 20 in fluid communication with the hollow core of the assembly. Drain valves 22 and 24 are provided which act to relieve fluid pressure from within passageway 20 to the bore hole. Each drain valve includes a valve seat 26, a valve ball 28 and a spring 30 to urge the ball into engagement with the valve seat with a predetermined force.

When the tool 10 is lowered into fluid within the bore hole, the tool admits fluid from the bore hole through the passageway 20 and into the hollow tubing forming the assembly 16. This reduces the buoyancy of the tool and assembly 16 to ensure proper operation. When removing the tool and assembly 16, it is necessary to permit the fluid to drain from the assembly 16 to lighten the total weight of the tool and assembly 16 and to prevent possible explosive fluids from being dumped on the floor of the drilling or workover rig. The drain valves 22 and 24 perform this function. Dual drain valves are employed for safety if one malfunctions. The drain valves also vent excess gas pressure or fluid pressure from the lower sections of the tool 10. In one tool constructed in accordance with the teachings of the present invention, the springs 30 were designed to permit the drain valves 22 and 24 to open at a pressure differential between the passageway and bore hole of greater than 30 psi.

A fluid container subassembly 32 is threaded to the lower end of the drain valve subassembly 18. The fluid container assembly includes a fluid container 34 therein in fluid communication with passageway 20. The fluid container can comprise any length desired. Typical values of length for the fluid container are 4 feet, 60 feet and 120 feet.

An upper valve subassembly 36 is secured to the lower end of the fluid container subassembly 32. Upper valve subassembly 36 has a central passage 38 in fluid communication with the fluid container 34. The upper valve subassembly 36 encloses an upper valve assembly 40 secured to a kelly 86. At the lower end of the upper valve subassembly 36 is threaded a changeover 42. The changeover permits a section having tubing threads or tool joint threads such as subassembly 36 to be secured to a section having a spline drive such as kelly 86. The changeover 42 also mounts a nipple 42 which extends upwardly into the passage 38 and threadably mounts the upper valve assembly 40.

The upper valve assembly 40 includes two separate one-way valves 46 and 48. One-way valve 48 includes a housing 50 having a ball seat 52 and ball 54. A ball stop 56 is provided to limit the motion of ball 54. One-way valve 46 includes a housing 58 defining a ball seat 60. A ball 62 is moveable into sealing contact with the ball seat 60, limited in its motion by ball stop 64.

Nipple 44 includes a passage 68. The passage 68 communicates with the port 70 through valve ball seat 60. A passage 72 interconnects the port 70 with port 74 in ball seat 52. A passage 76 extends from the one-way valve 48 into a passage 78 in a perforated nipple 80. It is clear that fluid may pass from passage 68 through the one-way valves 46 and 48 through the ports 82 in nipple 80 into the passage 38. However, fluid may not pass from the passage 38. However, fluid may not pass from the passage 38 in reverse flow into passage 68.

The nipple 80 prevents debris in the assembly 16 and tool 10 above the upper valve assembly 40 from clogging or plugging the passages through valve assembly 40. With valve assembly 40 installed, reverse circulation of fluid from the surface can be performed to loosen tool 10 from debris if necessary. The reverse circulation would drive fluid down the bore hole from the surface, about the lower portions of tool 10 described hereafter, through valve assembly 40 and returning the fluid to the surface within assembly 16.

A fishing neck 84 is secured at the top of a perforated nipple 80. The neck 84 is adapted for attachment to a changeover tool inserted within tool 10 to unthread the entire upper valve assembly 40 from nipple 44 and remove assembly 40 while the tool is down hole. This permits conventional circulation downward within assembly 16 to be run within the tool to loosen the tool from debris if desired.

The kelly 86 having a square outer cross section, a hollow center 87 and threaded splines at each end is threaded at its upper end to the changeover 42. A changeover safety lock 88 is provided to prevent loosening of the spline threads beteen the kelly and changeover. The changeover safety lock includes a lock flange 90 and two socket head bolts 92 to secure the lock flange to the changeover.

The lower assembly 14 includes a barrel 94 having internal threads at each end. An upper barrel nut 96 is threaded into the upper threads on barrel 94. The upper barrel nut 96 has a square aperture 98 for passage of the kelly 86. The kelly extends into the interior of barrel 94 and threadedly receives a seal, guide and swab piston assembly 102 on its lower splines. The barrel 94 defines a smooth cylindrical honed inner surface 104 along a substantial portion of its interior length.

The seal guide and swab piston assembly is designed for sliding sealed contact with the inner surface 104. The piston assembly includes brass guides 106 for guiding the assembly in its motion. Lip seals 108 are provided to perform the sealing function. The lip seals are poly-packed. In an alternative, the seals may be formed of Chevron Unipack seals.

A conical valve opener 110 is provided at the lower end of the piston assembly 102. The valve opener includes ports 112 extending both vertically and obliquely to a passage 114 through the interior of the assembly 102. The passage 114 is in fluid communication with the hollow interior 87 of kelly 86.

The upper annular surface of assembly 102 defines an upper stop 116. The upper stop is adapted for engagement with the upper barrel nut 96. Should the lower assembly 14 become buried within debris in the bore hole, the drill string assembly 16 and upper assembly 12 may be jerked upwardly, bringing upper stop 116 into engagement with the nut 96 to jerk the lower assembly 14 free. This feature forms a significant improvement over clean-out tools currently used. The large tensile strength available in the drill or tubing string assembly 16 and tool 10 permits this jerking action to be very effective.

The piston assembly 102 and barrel 94 define an annular chamber 118 and chamber 119 within the interior of the barrel. Passageways 120 are formed within the upper barrel nut 96 which opens at one end into the chamber 118. The passages extend to downwardly directed ports 122 opening into the bore hole. Rapid motion of the piston assembly 102 upwardly drives whatever fluid is in the chamber 118 through the passages 120 and ports 122 at a greatly increased velocity. The fluid emanating from the ports 122 agitates the debris and other material in the bore hole to render the clean-out operations more effective. In contrast to the Harrison device disclosed in U.S. Pat. No. 4,190,113; fluid discharged from ports 122 provides down thrust to pull fluid in the bore hole downward past the ports to assist in agitation. In one embodiment constructed in accordance with the teachings of the present invention, four jet ports 122 are provided.

A lower valve subassembly 124 is threaded to the lower internal threads of barrel 94. The interior of lower valve subassembly 124 is designed to accept a lower valve assembly 126. However, the lower valve assembly 126 is not employed when tool 10 is used in a hydraulic clean-out tool mode. Therefore, the assembly 126 will be discussed in greater detail hereinafter in describing hydrostatic operation.

A discharge and relief valve subassembly 128 is secured to the lower end of the subassembly 124. A passage 130 is formed through the subassembly 124 which communicates within the lower valve subassembly and chamber 119 in the interior of barrel 94 below the piston assembly 102. The subassembly 128 mounts discharge and relief valves 132 and 134. Each discharge and relief valve includes a ball seat 136, a ball 138 and a spring 140 to urge the ball into engagement with the seat.

The valves 132 and 134 relieve pressure within the passage 130 to the bore hole. When the piston assembly 102 is moved downwardly, the discharge and relief valves will limit the pressure in the fluid in the passage 130. This also relieves the stress on the lip seals on the piston assembly 102 during the downstroke. The orifice sizes of the assembly 16 and tool 10 above valves 132 and 134 are preferably sized to permit sets of sealer balls to be dropped from the surface, through assembly 16 and tool 10 to block valves 22 and 24 and/or the valves 132 and 134 during circulation through the tool. In particular, the vertical port 112 is sized to permit passage of such sealer balls.

A debris chamber subassembly 142 is secured at the bottom of the discharge valve subassembly. The hollow interior of the subassembly 142 forms a debris chamber 144. In operation, the tool will drive fluid and debris from within the bore hole into the debris chamber where the debris will settle. When the debris chamber has been filled, the tool is removed from the bore hole and the chamber is cleaned for reuse. The standard length of debris chamber is 50 feet. However, any suitable length may be employed for a particular situation.

A trap valve subassembly 146 is secured at the bottom of the debris chamber subassembly 142. The assembly 146 mounts a trap valve 148 formed by flapper 150 pivotally secured at one edge to open and close a port 152. The port communicates between chambers 154 and 156 in the subassembly 146. Chamber 154 opens into the debris chamber 144 of the debris chamber subassembly 142. Upward motion of the piston assembly 102 creates a vacuum within the lower assembly sufficient to open the flapper valve 150 to drive debris and fluid therethrough from the bore hole.

A jet port subassembly 158 is secured at the bottom of the trap valve subassembly 146 which forms a passage 160 in communication with chamber 156. Changeable angled jet ports 162 extend upwardly and inwardly from the bore hole into the passage 160. On the upstroke of the piston assembly 102, fluid from the bore hole is driven through the jet ports 162 to agitate moisture and lift the debris in the passage 160 for more effective debris collection. In prior hydraulic devices, clogging of the tool was common as a result of dehydration of debris from a slurry, forming hard deposits within the tool, particularly when the debris is sandy.

A changeover tool 164 is secured at the bottom of the jet port subassembly. The changeover 164 has a hollow center 165 and supports an accessory 166 at its bottom end. In the device illustrated in FIG. 1, the accessory is a drill bit 168. The accessory includes a hollow core 169 cooperating with the hollow core in changeover 164 to drive debris and fluid from the bore hole into passage 160 and eventually into debris chamber 144. Other accessories may be provided, such as a wash pipe, junk basket or other device adapted for a particular desired purpose. These accessories can be either devices which previously required circulation within the bore hole or not. As will be described hereafter, tool 10 will provide fluid circulation as necessary through its operation to render the accessories operative.

In operation, the tool 10 is run down the bore hole on the drill string assembly 16. As noted previously, for hydraulic operation, the upper valve assembly 40 is mounted within the upper valve subassembly 36. The lower valve assembly 126 is removed from the subassembly 124.

When the tool 10 has contacted the debris pile within the bore hole at drill bit 168, the drill string assembly 16 is reciprocated by a suitable mechanism at the surface. When the drill string assembly reciprocates, the upper assembly 12 duplicates the motion. The kelly and seal, guide and swab piston assembly 102 then reciprocates through aperture 98 and within the interior of barrel 94. On the downstroke of the seal, guide and swab piston assembly 102, substantially no resistance to the motion is provided by the fluid in the lower assembly. During this portion of motion, the discharge and relief valves 132 and 134 are employed to relieve pressure below the piston assembly 102. In addition, fluid may pass through the ports 112 in passage 114 in the seal, guide and swab piston assembly and through the one-way valves 46 and 48 in the upper valve assembly 40 for discharge through the drain valves 22 and 24.

On the upstroke, the one-way valves 46 and 48 close, evacuating the chamber in the interior of the lower assembly below the seal, guide and swab piston assembly 102. The vacuum drives debris and fluid from the bore hole through the internal passage 169 in the drill bit 168, through the flapper valve 150 and into the debris chamber 144 where the debris is deposited. As noted previously, the fluid within chamber 118 is driven through ports 122 to agitate the debris. The fluid passing through jet ports 162 further acts to agitate, moisturize and lift the debris in passage 160 to ensure effective collection.

If the tool 10 becomes stuck in the bore hole, the drill or tubing string assembly 16 may be jerked upwardly. This impacts the upper stop 116 against the upper barrel nut 96 to jerk the tool free. Reverse circulation can also be attempted. If this action is insufficient, a tool may remove the upper valve assembly 40 within the bore hole through attachment at the fishing neck 84. The changeover safety lock 88 is to prevent loosening of the kelly 86 from changeover 42. Conventional circulation can then be provided from the surface moving down the drill or tubing string assembly 16 and through the tool 10 to free the tool.

Figure 3:
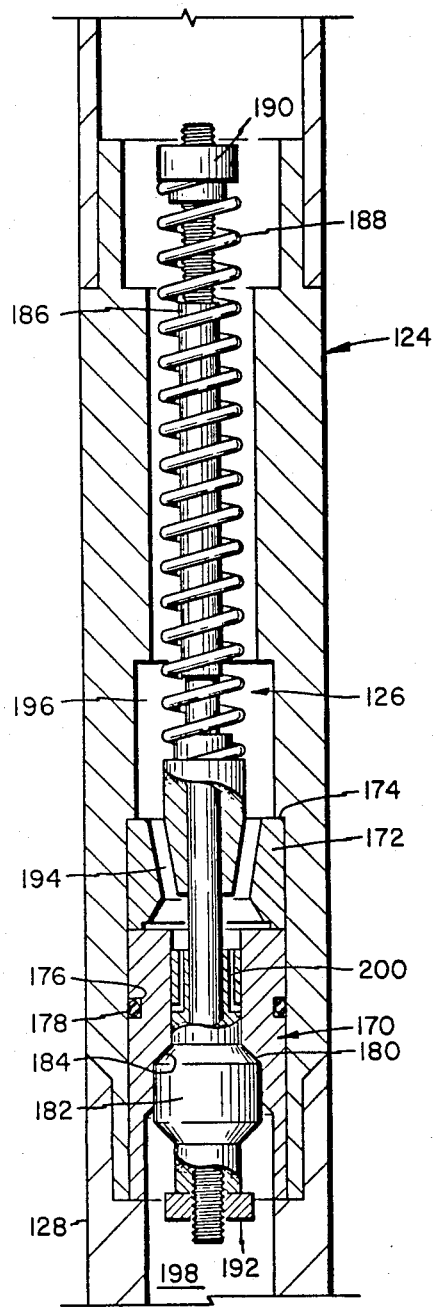
FIG. 3 is a vertical cross-sectional view of the lower valve assembly used in the tool in hydrostatic operation.

When operation as a hydrostatic tool is desired, the tool 10 is configured as illustrated in FIGS. 2 and 3. Many components of tool 10 are used in both hydraulic and hydrostatic operation. One difference in operation as a hydrostatic tool is the removal of the upper valve assembly 40 and the placement of the lower valve assembly 126 within the subassembly 124. The details of the lower valve assembly 126 are best illustrated in FIG. 3.

The lower valve assembly 126 includes a valve body 170 and a valve guide 172 which are confined between the annular surface 174 of the subassembly 124 and the discharge and relief valve subassembly 128. A groove 176 is provided in the outer wall of the valve body to accept an O-ring 178. The O-ring 178 prevents flow of fluid and debris about the outside of the lower valve assembly.

The valve body 170 includes a seal surface 180 which cooperates with a valve 182 through a seal surface 184 thereon. A valve release rod 186 extends upwardly from the valve 182 through the center of the valve guide. A spring 188 acts between a spring retainer nut 190, threaded on an upper threaded portion of the valve release rod and valve guide to urge the sealing surfaces 180 and 184 into sealing engagement in the absence of external influence. A retainer nut 192 threaded on a lower threaded portion of rod 186 secures the rod 186 to the valve 182. Either or both nuts 190 and 192 are adjusted to vary the compression of spring 188 and preload of surface 184 against surface 180.

When the valve is positioned as shown in FIG. 3, no fluid may travel through the passageways 194 between chambers 196 and 198 in the subassembly 124. However, if the rod 186 is moved downwardly through contact with valve opener 110, the sealing surface 184 is disengaged from surface 180 to permit fluid flow between the chambers through the passages 194. The passages 200 ensure a safe closing of the valve when the valve release rod is permitted to move upwardly by slowing the closing of the valve under the tremendous head pressures often encountered down hole.

In adapting the tool 10 for hydrostatic operation, the jet port subassembly 158 is positioned between the trap valve subassembly 146 and debris chamber subassembly 142 as illustrated in FIG. 2. In operation, the tool 10 is lowered down hole and suspended from the drill or tubing string assembly 16. Air at atmosphere pressure is confined within the interior of the string assembly 16, upper valve subassembly 36, chamber 119 and chamber 196. As the tool descends within the bore hole, the jet ports 162 admit fluid and valves 132 and 134 discharge air from within the lower assembly to reduce buoyancy to prevent the valve opener 110 from coming into contact with the valve release rod 186 until the lower assembly 14 comes to rest on the debris within the bore hole with the upper assembly 12 moveable downward to open the lower valve assembly 126. The assembly 16 is then moved downwardly to drive the valve opener 110 into the rod 186. This opens the lower valve assembly, permitting fluid and debris to rush into the debris chamber under the tremendous hydrostatic pressures typically found in bore holes where hydrostatic tool clean-out is most beneficial. When the pressures within the tool and drill string assembly have equalized, a large quantity of debris has been entered within the debris chamber and is maintained there by the trap valve 148. The tool may then be lifted to the surface for cleaning. Excess fluid in the assembly 16 and gas pressure is relieved by the drain valves 22 and 24 as the tool 10 moves to the surface. Discharge and relief valves 132 and 134 relieve pressure in the debris chamber 144 and lower assembly. Residual gas and pressure in down hole tools brought to the surface can be very hazardous to both equipment and personnel. Conventional and/or reverse circulation through the tool 10 is possible in the hydrostatic mode by holding lower valve assembly 126 open.

One significant advantage of tool 10 used in either hydrostatic or hydraulic operation is the ability to mount accessory 166 at the lower end of the lower assembly 14. When drill bit 168 is provided, the drill string assembly 16 may be rotated from the surface to rotate the drill bit against the debris. The square cross section of the kelly 86 and aperture 98 ensures that both lower and upper assemblies 12 and 14 rotate as a unit. The tool 10 may therefore be used to drill cement retainers or any type of plug or packer.

In addition, the tool 10 may be used with accessories using circulation since tool 10 provides fluid circulation in either the hydraulic or hydrostatic modes. If the accessory is a drill bit, tool 10 is capable of drilling a new hole or formation without the need for conventional or reverse fluid circulation to remove cuttings as presently used in drilling operations. For example, if sufficient fluid is provided in the bore hole to permit hydraulic operation of the tool 10, the drilling can be done by simultaneously reciprocating and rotating the drill string assembly, tool and drill bit. The cuttings from the face of the bore hole are driven into the debris chamber on the upstroke of the seal, guide and swab piston assembly entrained in fluid within the bore hole. The fluid then is replaced in the bore hole through one of the drain valves for suspending further cuttings. The drilling operation may then proceed until the debris chamber is completely filled. At that time, the tool may be removed to the surface and cleaned for further drilling. This technique eliminates the necessity of having large fluid pumps at the surface for driving circulating fluid down hole to the cutting face and returning it to the surface where it must be treated and the cuttings removed. In the hydrostatic mode, drilling would be performed and the cuttings collected in the debris chamber when the lower valve assembly 126 was opened. The tool 10 would be removed for cleaning and reinserted down hole for further drilling.

Figure 4:
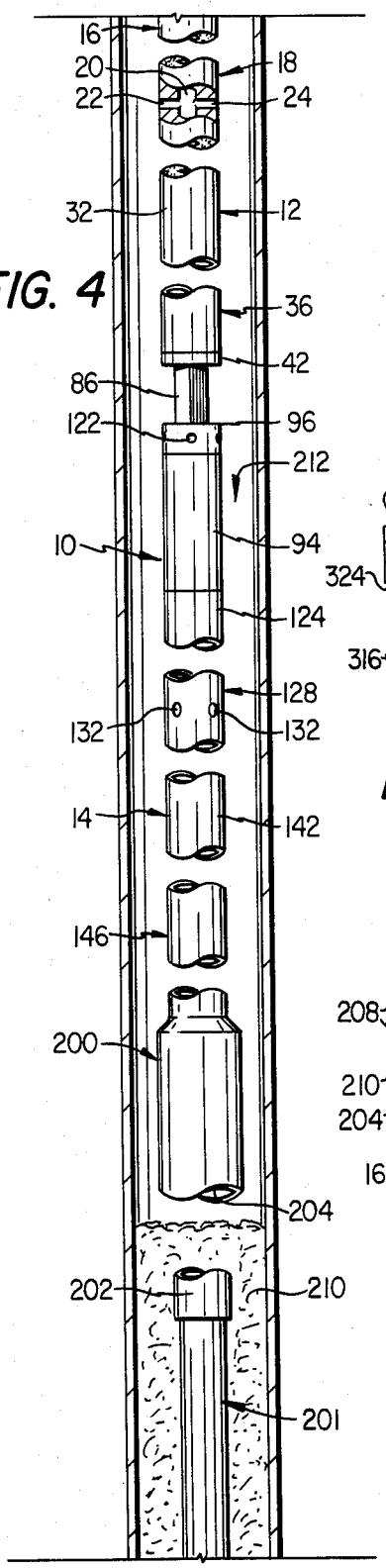
FIG. 4 is a vertical cross-sectional view of the tool for use with a wash pipe where the tool can be used in either a hydrostatic or hydraulic mode.

Tool 10 can be used with a wash pipe 200, as seen in FIG. 4, for removing objects 201 surrounded by or submerged in the debris 210 within the well bore 212 such as tubing 202. Tool 10 will typically be supported from a drill or tubing string assembly 16. Other objects such as logging tools, sinker bars, drill collars and the like can also be removed from the bore hole by tool 10 in combination with the wash pipe 200.

Figure 5:
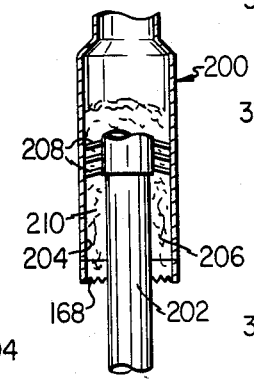
FIG. 5 is a partial vertical cross-sectional view of the tool for use with a wash pipe illustrating the debris wedged in the wash pipe for removal.

The wash pipe 200 is formed of an elongate cylinder having a hollow interior 204 with a sufficient diameter so that the tubing 202 can enter the interior 204 with clearance between the outer surface of the tubing 202 and the surface of interior 204 as best seen in FIG. 5. The tool 10 can be operated in either the hydrostatic or hydraulic mode to drive the debris 210 surrounding tubing 202 into the debris chamber 144 of the tool 10 in debris chamber subassembly 142. In the hydraulic mode, upper valve assembly 140 is positioned in the upper valve subassembly 36. The drain valves 22 and 24 have valve balls 28 and valve seats 26 removed therefrom in the hydraulic mode as seen in FIG. 4. Naturally, lower valve assembly 126 is removed from lower valve subassembly 124 during hydraulic operation. In hydrostatic operation, the upper valve assembly is removed and the valve seats 26, valve balls 28, springs 30 and lower valve assembly 126 are installed. The use of a jet port subassembly 158 is optional with tool 10 using wash pipe 200. Preferably, at least two trap valves 148 are used for operation of tool 10 with wash pipe 200. These trap valves 148 can be mounted in a single trap valve subassembly 146 as seen in FIG. 4, or multiple subassemblies 146 with each subassembly having a single trap valve 148.

As the debris 210 is driven by the hydraulic or hydrostatic forces through the hollow interior 204 of the wash pipe 200 and into the debris chamber 144, the drill or tubing string assembly 16, the tool 10 and wash pipe 202 are lowered within the bore hole 20 so that the wash pipe 200 moves downward over a portion of the tubing 202 as shown in FIG. 5.

After sufficient hydraulic or hydrostatic operation of tool 10 to insure that the tubing 202 extends well into the hollow interior 204 of the wash pipe 200, the debris collecting operation of tool 10 can be halted. When the debris collecting operation of tool 10 is halted, the debris 210 suspended between the trap valve 148 and the tubing 202 extending into the wash pipe 200 will fall by gravity and collect in the annular space 206 between the outer surface of tubing 202 and the inner surface of the hollow interior 204. The collected debris 210 is normally sufficient to wedge the tubing 202 within the wash pipe 200 so that when the drill or tubing string assembly 16, the tool 10 and wash pipe 200 are removed from the bore hole the tubing 202 will be also.

As can be seen, the use of tool 10 in association with a wash pipe 200 will provide an effective method for retrieving objects surrounding by, or even submerged in, debris. As noted previously, the retrieved object can be of any nature, including tubing, logging tools, sinker bars and drill collars, providing that at least a portion of the object to be retrieved can be wedged in the wash pipe 200. Clearly, the tool 10 and wash pipe 200 can also be used to collect debris that tool 10 could have done alone. A drill bit 168 can also be mounted on wash pipe 200 to conduct drilling operations as can be done with tool 10 and drill bit 168 alone.

A catcher device 208 of a known type, as illustrated in FIG. 5 can also be provided on the wash pipe 200 to positively secure the object to the wash pipe 200 in addition to reliance on the frictional forces provided by debris wedging in the annular space 206 between the object and the wash pipe 200. The catcher device can be a T-dog or junk basket, for example. However, in many cases the frictional forces provided by the debris will be adequate to remove the object. For example, if two 60 foot lengths of wash pipe 200 are employed to recover tubing such as tubing 202, the tool 10 can be operated to collect the debris 210 surrounding the tubing 202 while the tool 10 and wash pipe 200 are lowered over the tubing 202 so that a substantial portion of the wash pipe 200 is filled with the tubing 202, providing a significant length for debris 210 to collect in annular space 206 and provide large frictional forces which permit the object to be lifted from the well bore 212 even if it is wedged or otherwise secured within the well bore 212.

Tool 300, forming a first modification of tool 10, is illustrated in FIGS. 6–9 and described hereinafter. The tool 300 is used with a pack-off device 302 and a bridge plug set 304 (if needed) to perform a surge operation within the bore hole to drive debris 306 from formation 308, perforations 310 in casing 312 and from the bore hole itself.

Figure 7:
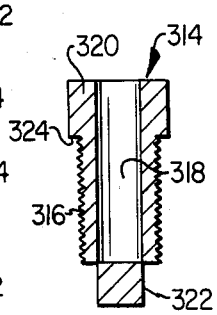
FIG. 7 is a cross-sectional view of a brass blank employed in the drain valves of the upper assembly.
Figure 6:
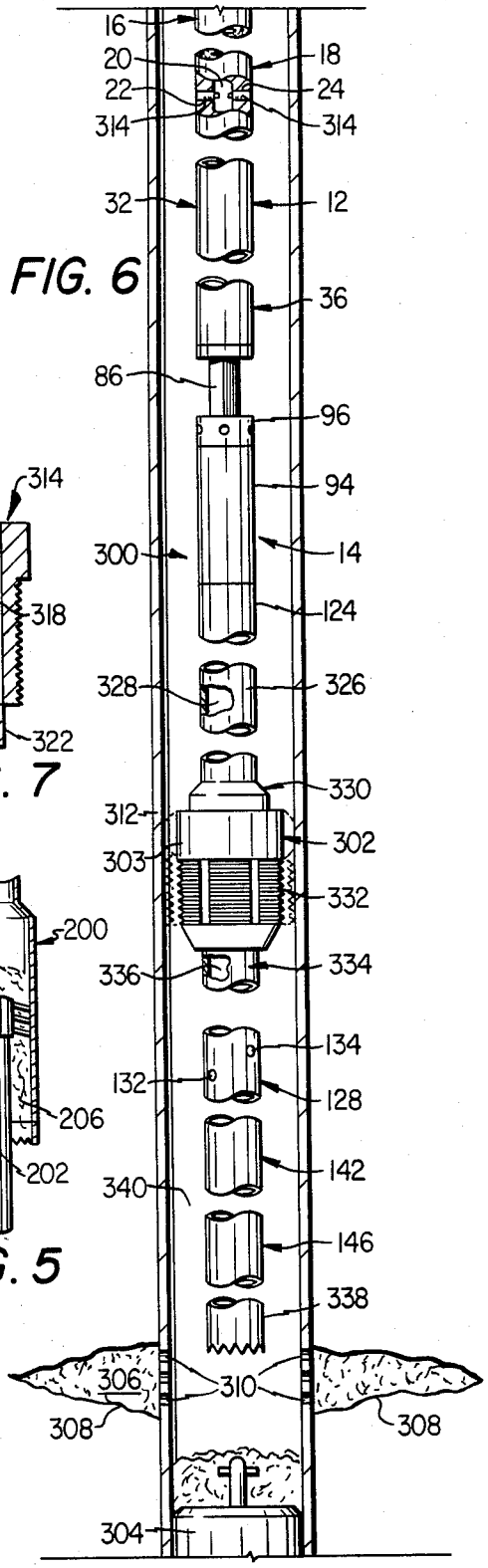
FIG. 6 is a vertical cross-sectional view of a first modification of the tool for operation in the hydraulic mode and adapted for use with a pack-off device for surging operations.

The tool 300 illustrated in FIGS. 6 and 7 is operated in the hydraulic mode. The tool 300 is again suspended in the bore hole by a drilling or tubing string assembly 16. The tool 300 includes the upper assembly 12 and lower assembly 14.

The upper assembly 12 includes drain valve subassembly 18 having drain valves 22 and 24. However, instead of a valve seat 26, valve ball 28, and spring 30 used in each of the drain valves 22 and 24 in tool 10, tool 300 has a brass blank 314 in each of the drain valves. The construction of brass blank 314 is best seen in FIG. 7. Brass blank 314 has outer threads 316 for threading into the drain valves 22 and 24. A passage 318 is formed in the brass blank 314 which opens through head 320 but is blocked by a solid shear portion 322 at the opposite end of passage 318. The head 320 has a seat 324 for fluid tight engagement against the drain valves 22 and 24. As is apparent, fluid cannot pass through passage 318 between the bore hole and passageway 20 within the subassembly 18 when the solid shear portions 322 block the passages 318. However, a bar can be dropped through the drilling or tubing string assembly 16 to shear the solid shear portion 322 from the brass blanks 314 to open the passages 318 and permit free flow between the passageway 20 and the bore hole.

Fluid container subassembly 32 is threaded to the lower end of the drain valve subassembly 18. In the preferred embodiment, the length of the fluid container subassembly 32 is between 120 and 200 feet. The fluid container subassembly 32 includes fluid container 34.

Upper valve assembly 36 is secured to the lower end of the fluid container subassembly 32, and in the hydraulic mode, includes the upper valve assembly 40 (not shown) mounted therein. Kelly 86 extends downward from the upper valve subassembly 36 and into the lower assembly 14.

The lower assembly 14 includes barrel 94. As in tool 10, the kelly 86 extends into the interior of barrel 94 and threadedly receives a seal, guide and swab piston assembly 102 (not shown). Lower valve assembly 124 is threaded to the lower end of barrel 94 and is designed to accept a lower valve assembly 126. However, the lower valve assembly 126 is not installed in lower valve subassembly 124 when the tool 300 is used in hydraulic mode.

A fluid container subassembly 326 is secured to the lower end of the lower valve subassembly 124. The fluid container subassembly 326 includes a fluid container 328 which is in fluid communication with the passage through the lower valve subassembly 124. In the preferred embodiment, the length of the fluid container subassembly 326 is between 120 and 200 feet.

A pack-off device subassembly 330 is mounted at the lower end of the fluid container subassembly 326. The pack-off device 302 of conventional design and operation is mounted along the subassembly 330 and acts not only to seal the annular space between the casing 312 and the tool 300 with seal 303 but, through anchoring structure 332, acts to anchor the tool 300 relative to the casing 312. The pack-off device subassembly 330 has a through passage connected to the fluid container 328 at its upper end.

A fluid container subassembly 334 is mounted at the lower end of the pack-off device subassembly 330. Fluid container subassembly 334 also includes a fluid container 336 which is in fluid communication with the passage through the pack-off device subassembly 330. In the preferred embodiment, the fluid container subassembly length is 120 to 200 feet.

A discharge and relief valve subassembly 128 is secured to the lower end of the fluid container subassembly 334. The passage 130 formed therein is in commuication with the fluid container 336 in the fluid container subassembly 334. The discharge and relief valve subassembly 128 mounts discharge and relief valves 132 and 134.

Debris chamber subassembly 142 is mounted beneath the discharge and relief valve subassembly 128. The debris chamber subassembly 142 has a debris chamber 144 therein. Trap valve subassembly 146 is mounted beneath the debris chamber subassembly 142. The subassembly 146 mounts at least one trap valve 148, but preferably two trap valves 148 in series.

A retrieving head 338 is mounted on the lower end of the trap valve subassembly 146 if a bridge plug set 304 is employed. The retrieving head 338 will be used to retrieve the bridge plug set 304 after surging of the formation 308, perforations 310 and bore hole. It will be understood that the use of the bridge plug set 304 will be principally to isolate perforations in the casing below the perforations 310 to be surged. When no perforations below 310 are encountered and the bore hole depth is not significant below perforations 310, a bridge plug set 304 need not be used.

In operation, the amount of debris to be collected should be estimated to provide sufficient volume in the debris chamber 144 to insure that the pack-off device 302 will always remain above the perforations 310. The entire tool 300 will be lowered to a depth in the bore hole sufficient to contact the debris 306 in the well bore so that the well bore can be cleaned out to the desired or total depth. The tool 300 is then pulled up in the bore hole to a level so that the pack-off device 302 is set above the perforations 310 to be surged. The pack-off device 302 is then activated as shown in phantom line in FIG. 6 to seal the annular space between the tool 300 and casing 312 and to anchor the tool within the well bore.

When operating in the hydraulic mode, sufficient fluid must be present in the bore hole to properly operate the tool. If insufficient fluid exists, fluid can be entered from the surface. Preferably, the opening at the retrieving head 338 will be proximate the perforations 310 so that the hydraulic forces generated by tool 300 are most directly applied for surging.

The tool 300 is then operated in the hydraulic mode by reciprocating the upper assembly 12 with the drilling or tubing string assembly 16. In the preferred embodiment, this reciprocating motion should not exceed a stroke length between 20 and 22 inches. It is also preferred that the piston assembly 102 not bump the barrel nut 96 on the upward stroke of the upper assembly 12 so as to avoid possible damage to the anchoring structure 332.

The reciprocatory motion of the upper assembly 12 creates a vacuum in the volume 340 within the bore hole and in the formation 308. This forces the debris 306 to move from the formation, through the perforations 310 and into tool 300 for collection in the debris chamber 144. Debris will also move from the well bore, fractures, cavities and other debris filled chambers into the tool 300. The collection of debris with the hydraulic action of the tool 300 can be continued until sufficient debris 306 has been removed from the formation 308 and perforations 310 to provide satisfactory production from the well.

As the debris 306 is driven from the formation 308 through perforations 310, some debris will settle downward in the bore hole, either to total depth or onto the top of the bridge plug set 304 if one is employed. After sufficient surging operations have been performed to clean the formation 308 and perforations 310, the anchor structure 332 can be deactivated and the tool 300 can be lowered to a depth sufficient to clean the bore hole to the total depth or down to the top of the bridge plug set 304. If a bridge plug set 304 is used, the retrieving head 338 will be attached to the bridge plug set 304 to release the bridge plug set 304. The tubing or drilling string assembly 16 will then be used to lift the tool 300 with the bridge plug set 304 to a level such that the lower end of the bridge plug set 304 is above the perforations 310. The tool 300 can then be left for a period of time, perhaps one hour, for fine debris to settle out below the tool 300 and be removed with the bridge plug set 304.

Before removal of the tool 300, it is preferred to drop a bar or run a sinker bar on a sand line downward within the drilling or tubing string assembly 16 to shear the portions 322 from the brass blanks 314. The shearing of these portions 322 will permit fluid in the drilling or tubing string assembly 16 to drain therefrom as the tool 300 is removed from the bore hole. If it is necessary to equalize the pressure on the pack-off device 302 prior to release of the anchoring structure 332, the portions 322 can be sheared from the brass blanks 314 prior to release of the anchoring structure 332 without affecting the final cleaning stage.

Figure 8:
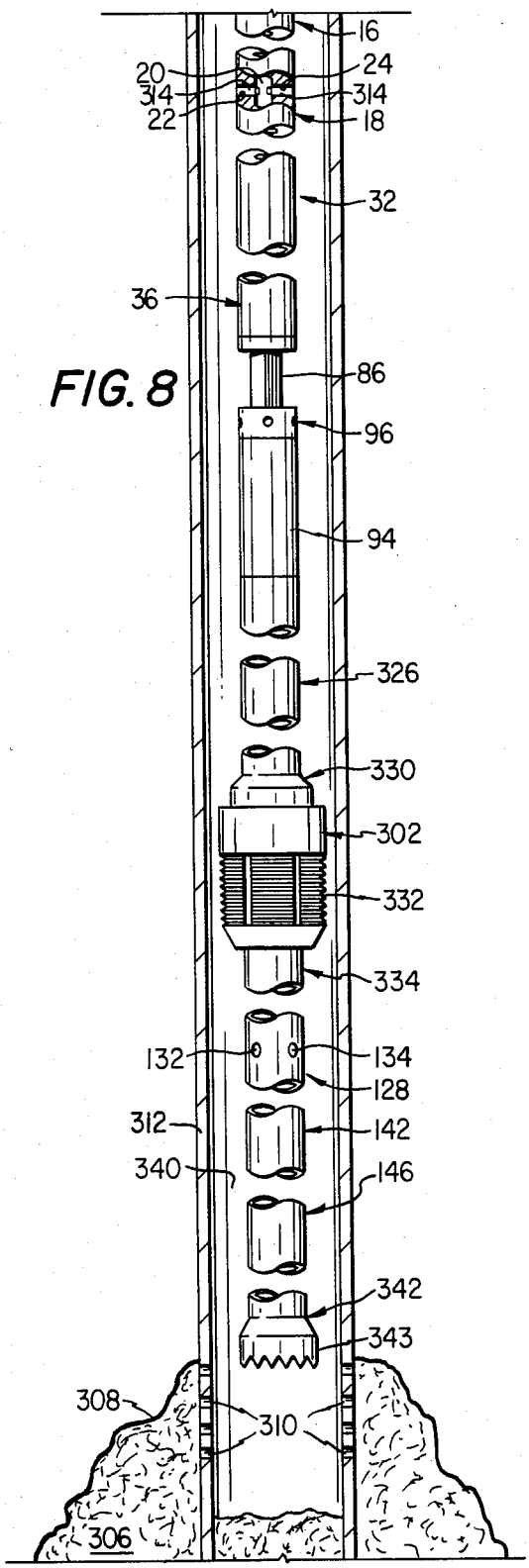
FIG. 8 is a vertical cross-sectional view of the first modification of the tool used with a pack-off device used in a hydrostatic mode.

FIG. 8 illustrates the use of tool 300 in a hydrostatic mode. In the hydrostatic mode, the upper valve assembly 40 will be removed from the upper valve subassembly 36 and the lower valve assembly 126 will be positioned in the lower valve subassembly 124. As can be seen in FIG. 8, no bridge plug set 304 is employed. Brass blanks 314 are positioned in drain valves 22 and 24. An accessory 342, such as a bit 343, snorkel, notched collar or other structure, is mounted at the lower end of the trap valve subassembly 146 to drill or perform another desired function.

The operation of the tool 300 in the hydrostatic mode is quite similar to the operation of tool 10 in the hydraulic mode, the seal, guide and swab piston assembly 102 will be moved downwardly to open the lower valve assembly 126 to create a significant vacuum in the volume 340 as the volume is exposed to the portions of the tool 300 and drilling or tubing string assembly 16 at atmospheric pressure. This vacuum will drive debris from the formation 308 through perforations 310 and into the debris chamber 144 of the tool 300. Naturally, the tool 300 would be operated in the hydrostatic mode when sufficient fluid is present in the bore hole to create an adequate head for effective hydraulic operation.

When the lower valve assembly 126 has been opened and debris collected through the hydrostatic operation, the anchoring structure 332 can be released to permit the tool to be removed to the surface, or be used for drilling or other desired function in the bore hole. A bar or sinker bar on a sand line would be used to shear the portions 322 of the brass blank 314 prior to removal to allow the fluid in the string assembly 16 to flow out.

Figure 9:
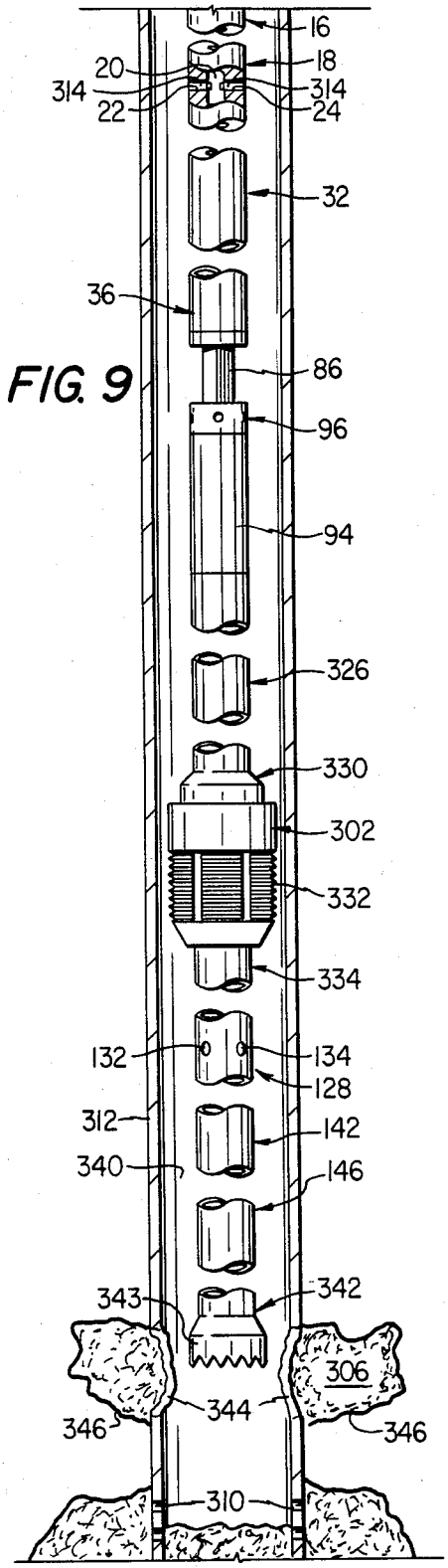
FIG. 9 is a vertical cross-sectional view of the first modification of the tool employing a pack-off device for cleaning a break in the casing to be squeezed.

FIG. 9 illustrates the use of a tool 300 operated in a hydraulic mode to clean out holes 344 in the casing 312 prior to squeezing the holes by filling the holes 344 and formation 346 by cement.

The tool 300 is operated as before in the hydraulic mode to drive the debris 306, including clay, mud, etc., from the formation 346, through holes 344 and into the debris chamber 144. Brass blanks 314 are again placed in drain valves 22 and 24. A bridge plug set 304 can be used to block communication between the bore hole near holes 344 and other perforations 310 in the bore hole. The tool 300 can also be used in the hydrostatic mode for cleaning debris 306 from formation 346, holes 344 and the bore hole.

Although a single embodiment of the invention has been illustrated in the accompanying drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A tool for use in a bore hole for retrieving an object surrounded by debris, comprising:

a lower assembly having means for mounting a wash pipe at the lower end thereof, a debris chamber for holding debris, at least one trap valve in fluid communication with the bore hole and debris chamber for permitting fluid and debris to flow only from the bore hole, through the wash pipe and into the debris chamber, a barrel section having a smooth, cylindrical inner wall, a lower valve assembly in fluid communication with said barrel section and said debris chamber, said lower valve assembly being activatable between an open position permitting fluid flow between the barrel section and debris chamber and a closed position blocking flow therebetween, and said barrel section having a closure means for enclosing one end of the inner wall and having an aperture therethrough;

an upper assembly having a hollow kelly for sliding motion through the aperture in said closure means for joint rotation of said upper and lower assemblies, a piston assembly mounted on the kelly in sliding, sealed contact with the inner wall of the barrel section to define a first chamber within the barrel section, said piston assembly having at least one port for communication between the first chamber and hollow kelly, the closure means and piston assembly being engageable, a fluid container and at least one drain valve for fluid communication between the fluid container and the bore hole to relieve fluid pressure within the fluid container, and an upper valve assembly being positioned for fluid communication between the hollow kelly and fluid container permitting flow only from the hollow kelly to the fluid container; and the tool being operable in a hydraulic mode by removing said lower valve assembly and said drain valves in the upper assembly with said upper valve assembly installed, reciprocating the upper assembly, the upward motion of said piston assembly driving fluid and debris from the bore hole, through the wash pipe and into the debris chamber through the trap valve, the trap valve closing and upper valve assembly opening on the downstroke to release the pressure in the debris chamber, and lowering the tool within the bore hole while reciprocating the upper assembly so that the object enters the wash pipe and can be removed from the bore hole with the tool and wash pipe, the tool being operable in a hydrostatic mode by removing said upper valve assembly with said lower valve assembly and drain valves installed, moving said upper assembly downward to activate said lower valve assembly to the open position through contact with said piston assembly, causing fluid and debris to be driven into the debris chamber, and lowering the tool within the bore hole so that the object enters the wash pipe and can be removed from the bore hole with the tool.

2. The tool of claim 1 wherein said piston assembly further defines a second chamber within said barrel section, said barrel section having downwardly directed jet ports opening into the bore hole and in fluid communication with the second chamber so that fluid under pressure is forced through the ports during the upstroke of the piston assembly to agitate the debris in the bore hole.

3. The tool of claim 1 further comprising a jet port section having a central passage and at least one jet port directed upwardly from the bore hole and in fluid communication with the central passage, said jet port section being placed between the trap valve and the debris chamber and in fluid communication with both during hydrostatic operation to prevent the piston assembly from opening the lower valve assembly during insertion in the bore hole, said jet port section being positioned between the trap valve and wash pipe and in fluid communication with both during hydraulic operation to drive fluid from the bore hole, through the wash pipe and into the central passage during the upstroke of the piston assembly to agitate and moisturize the fluid in the passage.

4. The tool of claim 1 wherein the upper valve assembly in said upper assembly may be removed when the tool is down hole to permit conventional circulation of fluid to free the tool within the bore hole.

5. The tool of claim 1 wherein said piston assembly and closure means are engageable with sufficient force to jar the lower assembly free when it becomes embedded within the bore hole.

6. The tool of claim 1 wherein a drill bit is mounted on the wash pipe secured to the tool, the closure means having a noncircular aperture and the kelly having a non-circular cross section for drilling with the tool.

7. The tool of claim 1 wherein the drain valves are retained in the upper assembly during operation in the hydraulic mode.

8. The tool of claim 1 further having a catcher device on the wash pipe for positively securing the object to the wash pipe.

9. A tool for use in a bore hole for retrieving an object surrounded by debris and operable with a drill or tubing string assembly, comprising:

an upper assembly secured to said string assembly and including:

(a) a drain valve subassembly having a passage therethrough opening into the bore hole to relieve the fluid pressure in the passage when it exceeds the pressure in the bore hole;

(b) a fluid container subassembly having a fluid container therein in fluid communication with the passage in said drain valve subassembly;

(c) an upper valve subassembly having an interior in fluid communication with the fluid container;

(d) a kelly having a passage therethrough secured in a fixed relation to said upper valve subassembly;

(e) an upper valve assembly extending into the interior of the upper valve subassembly, said upper valve assembly permitting fluid flow from the passage in the kelly to the interior of the upper valve assembly and preventing the reverse flow;

(f) a piston assembly secured to said kelly having a passage therethrough in fluid communication with the passage in the kelly;

a lower assembly including:

(a) a barrel having a smooth, cylindrical inner surface for sealing engagement with said piston assembly, the barrel and piston assembly defining a first chamber varying in volume as the piston assembly slides relative to the inner surface;

(b) a barrel nut secured to said barrel and preventing removal of said piston assembly from said barrel, said barrel nut having an aperture for passage of the kelly, the passage through the piston assembly permitting fluid communication between the passage in the kelly and the first chamber;

(c) a discharge and relief valve subassembly having a passage therethrough in fluid communication with the first chamber and having at least one discharge and relief valve positioned between the passage and bore hole to relieve fluid pressure in the passage when it exceeds a predetermined level above the pressure in the bore hole;

(d) a debris chamber subassembly having a debris chamber therein in fluid communication with the passage in said discharge and relief valve subassembly;

(e) at least one trap valve subassembly having first and second chambers interconnected by a port, the first chamber being in fluid communication with the debris chamber, and at least one trap valve for closing the port permitting fluid to flow from the second to first chamber and preventing flow from the first to second chamber;

(f) a wash pipe secured to the lower assembly, the second chamber of the trap valve subassembly being in fluid communication with the bore hole through the wash pipe;

the reciprocation of said upper assembly by the string assembly operating the tool in the hydraulic mode by reciprocating said piston assembly within said barrel to vary the volume of the first chamber, the upstroke of said piston assembly driving fluid and debris from about the object, through the wash pipe, through the trap valve and into said debris chamber subassembly for depositing the debris in the debris chamber, the downstroke of the piston assembly permitting fluid to flow through the upper valve assembly and to the bore hole through said drain valve subassembly, the collection of the debris permitting the wash pipe to be lowered over the object until the object extends into the wash pipe sufficiently to wedge the object in the wash pipe when reciprocation is stopped to permit removal of the object with the tool and wash pipe, the tool further being adapted for use either hydraulically or hydrostatically to provide fluid circulation for operation of the wash pipe.

10. The tool of claim 9 wherein the piston assembly and barrel define a second chamber, the second chamber being in fluid communication with the bore hole through a passage having at least one downwardly inclined port opening into the bore hole, reciprocation of the piston assembly within the barrel driving fluid within the second chamber to the bore hole through said port at high velocity, agitating the debris and fluid within the bore hole to increase debris collection.

11. The tool of claim 9 wherein said piston assembly and barrel nut are engageable to jar the lower assembly free.

12. The tool of claim 9 wherein said kelly has a noncircular cross section and the aperture in said barrel nut is noncircular to ensure joint rotation of the upper and lower assemblies.

13. The tool of claim 12 wherein a drill bit is mounted on the wash pipe, rotation of the string assembly rotating the upper assembly and lower assembly through the kelly to rotate the drill bit for drilling.

14. The tool of claim 9 further including a jet port subassembly having a passage in fluid communication with the second chamber of said trap valve subassembly and at least one passageway communicating between the passage and bore hole having a jet port upwardly inclined opening into the passage, the reciprocation of the piston assembly forcing fluid from the bore hole into the passage for agitating and moisturizing the fluid and debris for enhanced debris collection.

15. The tool of claim 9 wherein said upper valve assembly includes a fishing neck for attachment to a down hole tool for removing the upper valve assembly and permitting conventional circulation of fluid through the string assembly to free the tool.

16. The tool of claim 9 wherein said tool is operated in the hydrostatic mode by removing said upper valve assembly, providing a lower valve assembly and at least one drain valve in said drain valve subassembly positioned between the passage and bore hole to relieve the fluid pressure in the passage when it exceeds a predetermined level above the pressure in the bore hole, the lower valve assembly for permitting fluid flow between the debris chamber and barrel section in the open position and blocking flow in the closed position, downward movement of the string assembly, upper assembly and piston assembly opening said lower valve assembly for hydrostatic operation.

17. The tool of claim 9 further having a catcher device on the wash pipe for positively securing the object to the wash pipe.

18. A down hole tool for retrieving an object surrounded by debris, the tool activatable by a drill or tubing string assembly comprising:

a lower assembly defining an elongate member including:

(a) support means for mounting a wash pipe at one end of the lower assembly;

(b) a debris chamber for storing debris from the bore hole;

(c) a trap valve for permitting flow of fluid and debris from the bore hole, through the wash pipe and into the debris chamber, and preventing reverse flow;

(d) a discharge and relief valve assembly in fluid communication with said debris chamber for relieving fluid pressure therein to the bore hole;

(e) a barrel section defining a smooth, cylindrical interior surface, said barrel section including an upper barrel nut enclosing the interior surface at one end thereof and having a noncircular aperture therethrough, said barrel section having at least one downwardly directed port communicating with the bore hole for passage of a fluid therethrough to agitate the debris and fluid in the bore hole;

(f) a lower valve assembly for permitting fluid flow between the debris chamber and barrel section in the open position and blocking flow in the closed position;

an upper assembly defining an elongate member for attachment to the string assembly including:

(a) a kelly having a hollow passage therethrough for sliding motion through the aperture in the upper barrel nut;

(b) a piston assembly secured to said kelly within the barrel section of the lower assembly for sliding sealed contact with the cylindrical interior surface and defining first and second isolated chambers, the piston assembly having at least one passage therethrough permitting fluid communication between the hollow passage in the kelly and the first chamber, said piston assembly further activating the lower valve assembly to the open position on the downstroke of the piston assembly, the jet port communicating with the second chamber;

(c) a fluid container;

(d) an upper valve assembly permitting fluid flow only from the passage in the kelly to the fluid container;

(e) a drain valve assembly having a drain valve permitting fluid communication between the fluid container and the bore hole to relieve pressure within the fluid container into the bore hole, said drain valve further permitting fluid communication between the hollow interior of the string assembly and bore hole to relieve fluid pressure within the string assembly;

the tool being operable hydraulically by removing said lower valve assembly and drain valve to permit free flow between the fluid container and bore hole with the upper valve assembly installed and reciprocating the string assembly and the piston assembly to pump fluid and debris from the bore hole, through the wash pipe and through the trap valve for deposition of debris in the debris chamber, the upper valve assembly being closed on the upstroke of the piston assembly and opening on the downstroke to pass fluid therethrough for discharge through the drain valve assembly to operate the tool as a hydraulic clean-out tool, the collection of the debris permitting the wash pipe to be lowered over the object until the object extends into the wash pipe sufficiently to wedge the object in the wash pipe when reciprocation is stopped to permit removal of the object from the bore hole with the tool and wash pipe, downward motion of the string assembly with said lower valve assembly in the lower assembly, said drain valve installed in the drain valve assembly and said upper valve assembly removed moving said piston assembly into contact with said lower valve assembly to open the lower valve assembly permitting fluid and debris to enter the debris chamber for depositing debris therein to operate the tool as a hydrostatic clean-out tool, the collection of the debris permitting the wash pipe to be lowered over the object until the object extends into the wash pipe sufficiently to wedge the object in the wash pipe to permit removal of the object from the bore hole with the tool and wash pipe.

19. The down hole tool of claim 18 wherein said lower assembly further includes a jet assembly having at least one upwardly directed jet extending into a passage in the lower assembly in communication with the debris chamber for passage of fluid therethrough to agitate and moisturize the debris and fluid in the passage.

20. The down hole tool of claim 18 wherein said upper barrel nut forms a stop to limit the motion of the piston assembly permitting the lower assembly to be jarred free from within the bore hole by upward movement of the string assembly and upper assembly.

21. The tool of claim 18 wherein the upward motion of the piston assembly when the tool is operated hydraulically drives fluid within the second chamber through the downwardly directed port to agitate the fluid and debris within the bore hole for enhanced collection of debris.

22. The tool of claim 18 further including a jet port subassembly having an internal passage in fluid communication with the bore hole through at least one upwardly directed port entering the passage, said jet port subassembly being positioned between the trap valve and bore hole when the tool is operated hydraulically to force fluid into the passage from the bore hole to agitate and moisturize the fluid and debris in the passage, said jet port subassembly being positioned between the trap valve and debris chamber when the tool is operated hydrostatically to prevent upward motion to the lower assembly relative to the upper assembly when inserting the tool within the bore hole.

23. The tool of claim 18 wherein the upper valve assembly is removable from the tool within the bore hole to permit conventional circulation of fluid to free the tool from within the bore hole.

24. The tool of claim 18 wherein the kelly has a noncircular cross section and the aperture in the upper barrel has a noncircular cross section ensuring joint rotation of the upper and lower assemblies.

25. The tool of claim 24 further having a drill bit secured on the wash pipe for drilling with said tool.

26. The tool of claim 18 further having a catcher device on the wash pipe for positively securing the object to the wash pipe.

27. A method for retrieving an object from a bore hole containing debris comprising the steps of:

supporting a tool with a drill or tubing string assembly, the tool having upper and lower assemblies, the string assembly being secured to the upper assembly of the tool;

supporting a wash pipe on the lower assembly of the tool;

reciprocating the string assembly and upper assembly of the tool relative to the lower assembly of the tool, the upper assembly having a piston assembly in slidable sealed contact with a barrel section of the lower assembly having an inner sealing surface therein, the piston assembly being secured to a kelly on the upper assembly, the kelly passing through an aperture in the barrel section, the upward motion of the piston assembly driving fluid and debris from within the bore hole through the wash pipe into a debris container within the lower assembly to deposit the debris therein, the downward motion of the piston assembly driving fluid through an upper valve assembly in the upper assembly and discharging the fluid through at least one opening into the bore hole, the collection of the debris permitting the wash pipe to be lowered over the object until the object extends into the wash pipe sufficiently to permit the tool and wash pipe to remove the object from the bore hole; and removing the tool and wash pipe from the bore hole to retrieve the object from the bore hole.

28. A method for retrieving an object from a bore hole having debris therein comprising the steps of:

suspending a tool within the bore hole with a drill or tubing string assembly, the tool having upper and lower assemblies, the drill or tubing string assembly being secured to the upper assembly of the tool;

mounting a wash pipe on the lower assembly of the tool;

moving the drill or tubing string assembly and upper assembly of the tool downwardly toward the lower assembly of the tool, the upper assembly having a piston assembly with a valve opener in slidable sealed contact with a barrel section of the lower assembly having an inner sealing surface therein, the piston assembly being secured to a kelly on the upper assembly, the kelly passing through an aperture in the barrel section, the downward motion of the piston assembly opening a lower valve assembly through the valve opener, permitting fluid and debris from within the bore hole to pass through the wash pipe and to enter a debris chamber within the lower assembly to deposit the debris therein, the hydrostatic pressure within the bore hole driving the fluid and debris into the debris chamber, the collection of the debris permitting the wash pipe to be lowered over the object until the object extends into the wash pipe sufficiently to permit the tool and wash pipe to remove the object from the bore hole; and removing the tool and wash pipe from the bore hole to retrieve the object from the bore hole.

29. A tool for use in a bore hole, the bore hole having a casing and at least one passage through the casing opening into a formation, the tool for cleaning debris from the formation, passage and bore hole and for debris collection comprising:

a lower assembly having a debris chamber for holding debris, a trap valve in fluid communication with the bore hole and debris chamber for permitting fluid and debris to flow only from the bore hole into the debris chamber, a discharge and relief valve in fluid communication with the debris chamber and the bore hole to relieve fluid pressure in the debris chamber when it exceeds a predetermined level above the pressure in the bore hole, at least one lower assembly fluid chamber in fluid communication with the debris chamber, a barrel section having a smooth, cylindrical inner wall, a lower valve assembly in fluid communication with said barrel section and said lower assembly fluid chamber through the fluid chamber, said lower valve assembly being activatable between an open position permitting fluid flow between the bore hole and debris chamber and a closed position blocking flow therebetween and said barrel section having a closure means for enclosing one end of the inner wall and having a noncircular aperture therethrough;

a pack-off device mounted on said lower assembly to form a fluid tight seal between the lower assembly and the interior of the casing and anchoring the tool to the casing, the pack-off device being positioned above the opening in the casing;

an upper assembly having a hollow kelly with a noncircular cross section for sliding motion through the aperture in said closure means for joint rotation of said upper and lower assemblies, a piston assembly mounted on the kelly in sliding, sealed contact with the inner wall of the barrel section to define a first chamber within the barrel section, said piston assembly having at least one port for communication between the first chamber and hollow kelly, the closure means and piston assembly being engageable, an upper assembly fluid chamber and at least one drain valve for fluid communication between the upper assembly fluid chamber and the bore hole to relieve fluid pressure within the upper assembly fluid chamber, each of said drain valves having plug means to prevent flow through the drain valve, and an upper valve assembly being positioned for fluid communication between the hollow kelly and upper assembly fluid chamber permitting flow only from the hollow kelly to the upper assembly fluid chamber;

the tool being operable as a hydraulic clean-out tool to clean the formation, passage and bore hole by removing said lower valve assembly with said upper valve assembly installed, forming a seal between the lower assembly and casing and anchoring the lower assembly to the casing with the pack-off device and reciprocating the upper assembly, the upward motion of said piston assembly driving fluid and debris from the formation, throught the passage and bore hole into the debris chamber through the trap valve, the trap valve closing and upper valve assembly opening on the downstroke to release the pressure in the debris chamber, the tool being operable as a hydrostatic tool by removing said upper valve assembly with said lower valve assembly installed, forming a seal between the lower assembly and casing and anchoring the lower assembly to the casing with the pack-off device, downward motion of said upper assembly activating said lower valve assembly to the open position through contact with said piston assembly driving fluid and debris into the debris chamber.

30. The tool of claim 29 wherein said piston assembly further defines a second chamber within said barrel section, said barrel section having downwardly directed jet ports opening into the bore hole and in fluid communication with the second chamber so that fluid under pressure is forced through the ports during the upstroke of the piston assembly to agitate the debris in the bore hole.

31. The tool of claim 29 wherein said pack-off device is released to allow downward movement of the tool in the bore hole, the tool being operable in a selected mode for further cleaning of the bore hole.

32. The tool of claim 29 wherein said plug means is a brass blank with a portion for shearing by a bar to permit flow through the drain valves upon shearing of the portion.

33. The tool of claim 29 wherein a bridge plug set is employed to isolate the passage in the bore hole between the pack-off device and bridge plug set, the tool having a retrieving head secured to the lower assembly for retrieving the bridge plug set.

34. The tool of claim 29 wherein the passage is a perforation into a producing formation.

35. The tool of claim 29 wherein the passage is a hole to be squeezed, the tool cleaning debris to form an effective squeeze.

36. The tool of claim 29 wherein said lower assembly has means for mounting an accessory, the accessory being a drill bit, said upper assembly being rotated to rotate said lower assembly and drill bit to drill within the bore hole.

37. The tool of claim 36 wherein the tool is operated to drill with the bore hole and said upper assembly is reciprocated to circulate fluid within the bore hole and deposit cuttings from the drilling within the debris chamber.

38. The tool of claim 29 wherein the upper valve assembly in said upper assembly may be removed when the tool is down hole to permit conventional circulation of fluid to free the tool within the bore hole.

39. The tool of claim 29 wherein said piston assembly and closure means are engageable with sufficient force to jar the lower assembly free when it becomes embeded within the bore hole.

40. A tool for use in a bore hole, the bore hole having a casing and at least one passage through the casing opening into a formation, the tool for cleaning debris from the formation, passage and bore hole and for debris collection and operable with a drill or tubing string assembly, comprising:

an upper assembly secured to said drill string assembly and including:

(a) a drain valve subassembly having a passage therethrough and at least one drain valve assembly positioned between the passage and bore hole to relieve the fluid pressure in the passage, the drain valve assembly including means for initially preventing fluid flow between the passage and bore hole through the drain valve assembly and permitting such flow upon activation of said drain valve assembly;

(b) an upper assembly fluid container subassembly having an upper assembly fluid container therein in fluid communication with the passage in said drain valve subassembly;

(c) an upper valve subassembly having an interior in fluid communication with the fluid container;

(d) a kelly having a noncircular cross section and a passage therethrough secured in a fixed relation to said upper valve subassembly;

(e) an upper valve assembly extending into the interior of the upper valve subassembly, said upper valve assembly permitting fluid flow from the passage in the kelly to the interior of the upper valve assembly and preventing the reverse flow;

(f) a piston assembly secured to said kelly having a passage therethrough in fluid communication with the passage in the kelly;

a lower assembly including:

(a) a barrel having a smooth, cylindrical inner surface for sealing engagement with said piston assembly, the barrel and piston assembly defining a first chamber varying in volume as the piston assembly slides relative to the inner surface;

(b) a barrel nut secured to said barrel and preventing removal of said piston assembly from said barrel, said barrel nut having a noncircular aperture for passage of the kelly to ensure joint rotation of the upper and lower assemblies, the passage through the piston assembly permitting fluid communication between the passage in the kelly and the first chamber;

(c) a first lower assembly fluid container subassembly having a lower assembly fluid container therein in fluid communication with the first chamber;

(d) a second lower assembly fluid container subassembly having a lower assembly fluid container therein in fluid communication with the lower assembly fluid container of the first lower assembly fluid container;

(e) a discharge and relief valve subassembly having a passage therethrough in fluid communication with the lower assembly fluid container of the second lower assembly fluid container and having at least one discharge and relief valve positioned between the passage and bore hole to relieve fluid pressure in the passage when it exceeds a predetermined level above the pressure in the bore hole;

(f) a debris chamber subassembly having a debris chamber therein in fluid communication with the passage in said discharge and relief valve subassembly;

(g) a trap valve subassembly having first and second chambers interconnected by a port, the first chamber being in fluid communication with the debris chamber, and at least one trap valve for closing the port permitting fluid to flow from the second to first chamber and preventing flow from the first to second chamber;

a pack-off device secured to the lower assembly for forming a seal between the casing and lower assembly above the discharge and relief valve subassembly and for anchoring the lower assembly to the casing above the passage;

the reciprocation of said upper assembly by the string assembly reciprocating said piston assembly within said barrel to vary the volume of the first chamber, the upstroke of said piston assembly driving fluid and debris from the formation, passage and bore hole through the trap valve in said trap valve subassembly for depositing the debris in the debris chamber, the downstroke of the piston assembly permitting fluid to flow through the discharge and relief valve and through the upper valve assembly into the upper assembly and string assembly, the tool further being adapted for use either hydraulically or hydrostatically.

41. The tool of claim 40 further having an accessory secured in a fixed relationship to the trap valve subassembly.

42. The tool of claim 41 wherein said accessory is a drill bit, rotation of the drill string assembly rotating the upper assembly and lower assembly through said kelly to provide rotation to the drill bit for drilling.

43. The tool of claim 42 wherein drilling is performed by rotating said upper and lower assemblies through the drill string assembly and collection of the cuttings is performed by reciprocating the piston assembly within the barrel to drive fluid and cuttings into the debris container to collect the cuttings.

44. The tool of claim 41 wherein the accessory is a retrieving head for retrieving a bridge plug set in the bore hole below the passages.

45. The tool of claim 40 wherein said upper valve assembly includes a fishing neck for attachment to a downhole tool for removing the upper valve assembly and permitting conventional circulation of fluid through the string assembly to free the tool.

46. The tool of claim 40 wherein the pack-off device is detached from the casing to permit the tool to move downward in the bore hole for further debris collection.

47. The tool of claim 40 wherein the passage is a perforation into a producing formation.

48. The tool of claim 40 wherein the passage is a hole to be squeezed.

49. A tool for use in a bore hole having a casing and at least one passage through the casing opening into a formation, the tool for cleaning debris from the formation, passage and bore hole and for debris collection, the tool activatable by a drill or tubing string assembly comprising:

a lower asssembly defining an elongate member including:

(a) support means for mounting an accessory at one end of the lower assembly;

(b) a debris chamber for storing debris from the bore hole;

(c) at least one trap valve for permitting flow of fluid and debris only into the debris chamber from the bore hole;

(d) a discharge and relief valve assembly in fluid communication with said debris chamber for relieving fluid pressure therein to the bore hole;

(e) at least one lower assembly fluid container subassembly having a lower assembly fluid container therein in fluid communication with said discharge and relief valve assembly;

(f) a barrel section defining a smooth, cylindrical interior surface, said barrel section including an upper barrel nut enclosing the interior surface at one end thereof and having a noncircular aperture therethrough, said barrel section being in fluid communication with the lower assembly fluid container of the lower assembly fluid container subassembly;

(g) a lower valve assembly for permitting fluid flow between the debris chamber and barrel section in the open position and blocking flow in the closed position;

an upper assembly defining an elongate member for attachment to the drill string assembly including:

(a) a kelly having a hollow passage therethrough and a noncircular cross section for sliding motion through the aperture in the upper barrel nut, the cross section of said kelly and aperture ensuring joint rotation of the upper and lower assemblies upon rotation of the string assembly;

(b) a piston assembly secured to said kelly within the barrel section of the lower assembly for sliding sealed contact with the cylindrical interior surface and defining first and second isolated chambers, said upper barrel nut forming a stop to limit the motion of the piston assembly permitting the lower assembly to be jarred free from within the bore hole by upward movement of the string assembly and upper assembly, the piston assembly having at least one passage therethrough permitting fluid communication between the hollow passage in the kelly and the first chamber, said piston assembly further activating the lower valve assembly to the open position on the downstroke of the piston assembly;

(c) an upper assembly fluid container;

(d) an upper valve assembly permitting fluid flow only from the passage in the kelly to the fluid container;

(e) a drain valve assembly for permitting fluid communication between the upper assembly fluid container, string assembly and the bore hole to relieve pressure within the upper assembly fluid container and string assembly into the bore hole, said drain valve preventing fluid communication between the hollow interior of the drill string assembly and bore hole until said drain valve assembly is activated;

the tool being operable hydraulically by removing said lower valve assembly with the upper valve assembly installed, sealing and anchoring the lower assembly to the casing with the pack-off device and reciprocating the string assembly and the piston assembly to pump fluid and debris from the formation, passage and bore hole through the trap valve for deposition of debris in the debris chamber, the upper valve assembly being closed on the upstroke of the piston assembly and opening on the downstroke to pass fluid therethrough to operate the tool as a hydraulic surging tool, downward motion of the drill string assembly with said lower valve assembly in the lower assembly, said upper valve assembly removed and the pack-off device sealing and anchoring the lower assembly to the casing moving said piston assembly into contact with said lower valve assembly to open the lower valve assembly permitting fluid and debris to enter the debris chamber for depositing debris therein to operate the tool as a hydrostatic surging tool.

50. The tool of claim 49 wherein the accessory mounted on said attachment means comprises a drill bit, the rotation of the string assembly and tool permitting drilling within the bore hole.

51. The tool of claim 50 wherein the tool is operated hydrostatically to drive fluid and cuttings from the drilling into the debris chamber to deposit the cuttings therein to provide continuous drilling until the debris chamber is filled with the cuttings.

52. The tool of claim 49 wherein the upper valve assembly is removable from the tool within the bore hole to permit conventional circulation of fluid to free the tool from within the bore hole.

53. The tool of claim 49 wherein said drain valve assembly includes a brass plug with a shearable portion blocking a passage through the brass plug, a bar being used to activate the drain valve assembly by shearing the shearable portion from the brass plug to open the passage to permit fluid flow between the fluid container, string assembly and bore hole.

54. The tool of claim 49 wherein said accessory is a retrieving head for retrieving a bridge plug set in the bore hole.

55. The tool of claim 49 wherein the pack-off device can be deactivated to permit the tool to move downward from the casing to permit further cleaning of the bore hole.

* * * * *